US005926871A

United States Patent [19]

Howard

[11] Patent Number: 5,926,871

[45] Date of Patent: Jul. 27, 1999

[54] TANNING COT CONSTRUCTION

[76] Inventor: Troy D. Howard, 14900 U.S. Rte. 50, Bainbridge, Ohio 45612

[21] Appl. No.: 09/153,524

[22] Filed: Sep. 15, 1998

[51] Int. Cl.[6] ..... A47C 17/64

[52] U.S. Cl. ..... 5/111; 5/656; 297/900; D6/361

[58] Field of Search ..... 5/110, 111, 112, 5/638, 725, 656, 657, 922; 297/900; D6/361

[56] References Cited

U.S. PATENT DOCUMENTS

| | | | |
|---|---|---|---|
| D. 352,635 | 11/1994 | Yoder | D6/611 |
| 3,897,102 | 7/1975 | Lemaire | 5/111 |
| 4,606,086 | 8/1986 | Rowland | 297/900 |
| 4,891,854 | 1/1990 | Finkelstein | 5/111 |
| 5,177,823 | 1/1993 | Riach | 5/638 |

*Primary Examiner*—Alex Grosz
*Attorney, Agent, or Firm*—Thomas S. Baker, Jr.

[57] ABSTRACT

A tanning cot assembly is provided with a portable and foldable rigid support frame, a human-body support surface carried by the support frame, a face-opening frame carried by the support surface and having an interior face-opening, and an adjustably positioned head support only partially filling but spanning the face-opening frame interior face-opening.

3 Claims, 3 Drawing Sheets

TANNING COT CONSTRUCTION

CROSS-REFERENCES

None.

FIELD OF THE INVENTION

This invention relates generally to cots of the type used by human beings in connection with body tanning, and particularly concerns a foldable or collapsible cot construction having a novel head support for the user's forehead when positioned on the cot in a face-down, supine position.

BACKGROUND OF THE INVENTION

Portable and foldable cots for human use in obtaining a skin tan in either natural or artificial sunlight are well known, but such cots have proven quite uncomfortable for use by individuals who wish to obtain their skin tan while in a face-down, supine position. Such known portable and foldable cots also do not facilitate or readily permit the user to read printed material such as conventional books or magazines while assuming a face-down supine skin tanning position on the cot.

Accordingly, an important object of the present invention is to provide a tanning cot assembly which may be utilized to readily overcome the aforesaid shortcomings of the known prior art.

Other objects and advantages of the present invention will become apparent from a consideration of the drawings, descriptions, and claims which follow.

SUMMARY OF THE INVENTION

The tanning cot construction of the present invention comprises a foldable rigid support frame, a yieldable human-body support surface carried by the support frame, a face-opening provided in the human-body support surface, and a head support bar carried by the human-body support surface. The head support bar spans the face-opening in the human-body support surface, and may be adjustably positioned at different locations in the longitudinal extent of the face-opening.

DETAILED DESCRIPTION

Figure 1:
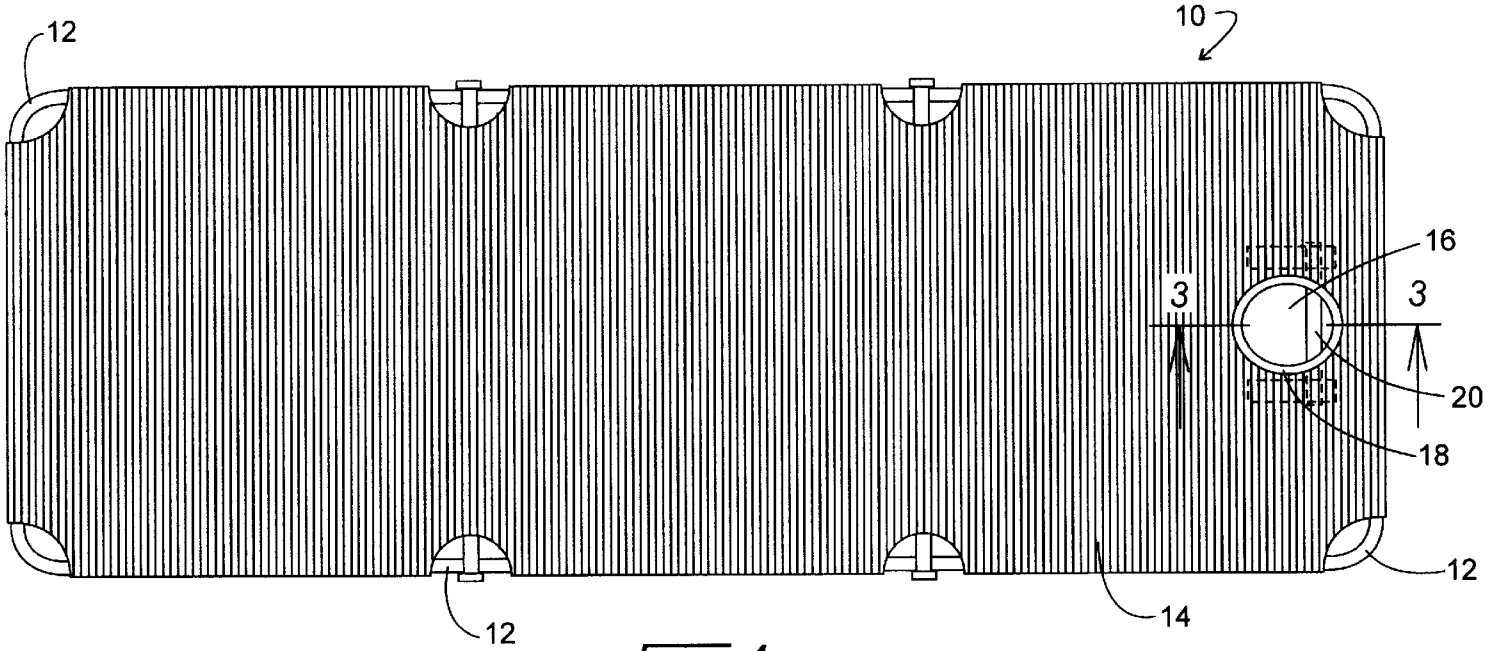
FIG. 1 is a plan view of a preferred embodiment of the tanning cont of the present invention.
Figure 2:
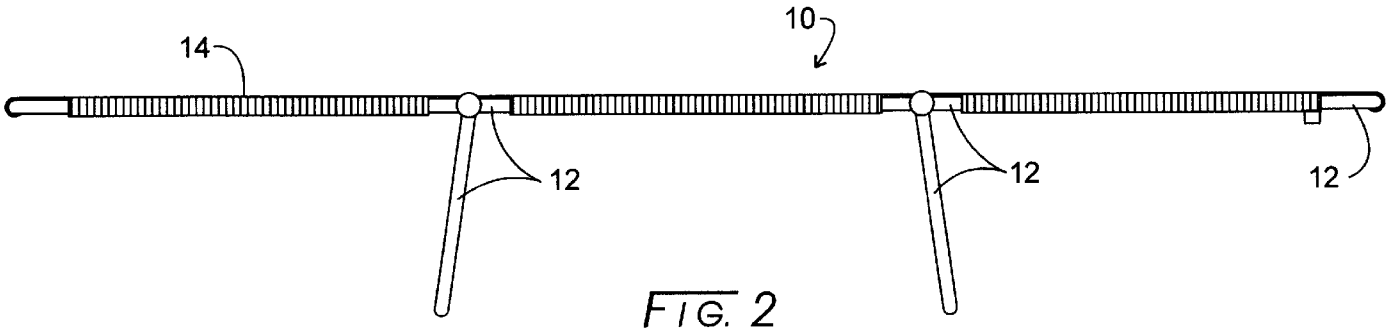
FIG. 2 is an side elevation view of the tanning cot illustrated in FIG. 1.

FIG. 1 illustrates a preferred embodiment of the present invention which is referenced generally in the drawings by the numeral 10 and which is basically comprised of a portable and foldable support frame 12 and a co-operating yieldable human-body support surface 14. Other than being foldable, support frame 12 is preferably largely made of a light-weight and rigid metal such as extruded aluminum, and human-body support surface 14 is made of a yieldable material such as a canvas-like, heavy-duty woven fabric. Human-body support surface 14 is secured to frame 12 by conventional fastener devices.

Figure 5:
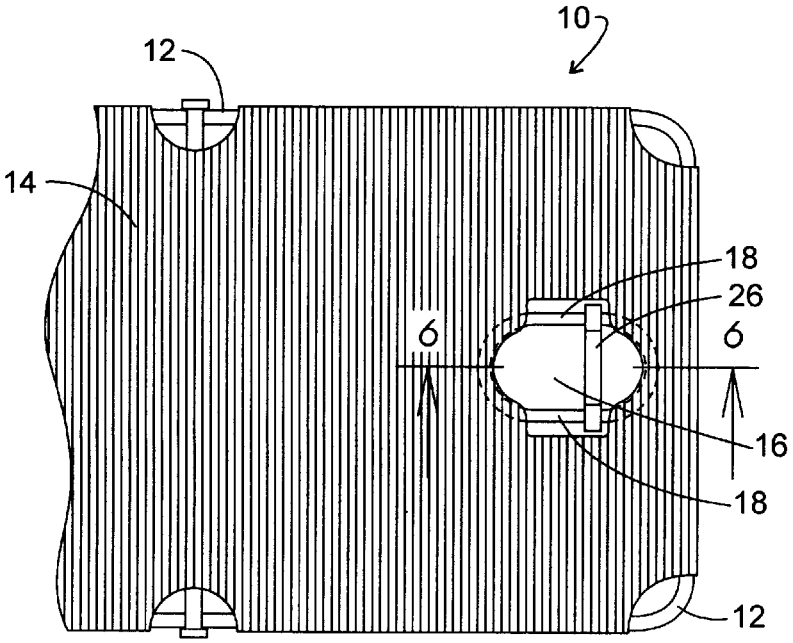
FIG. 5 is a plan view of a portion of another embodiment of the present invention.
Figure 6:
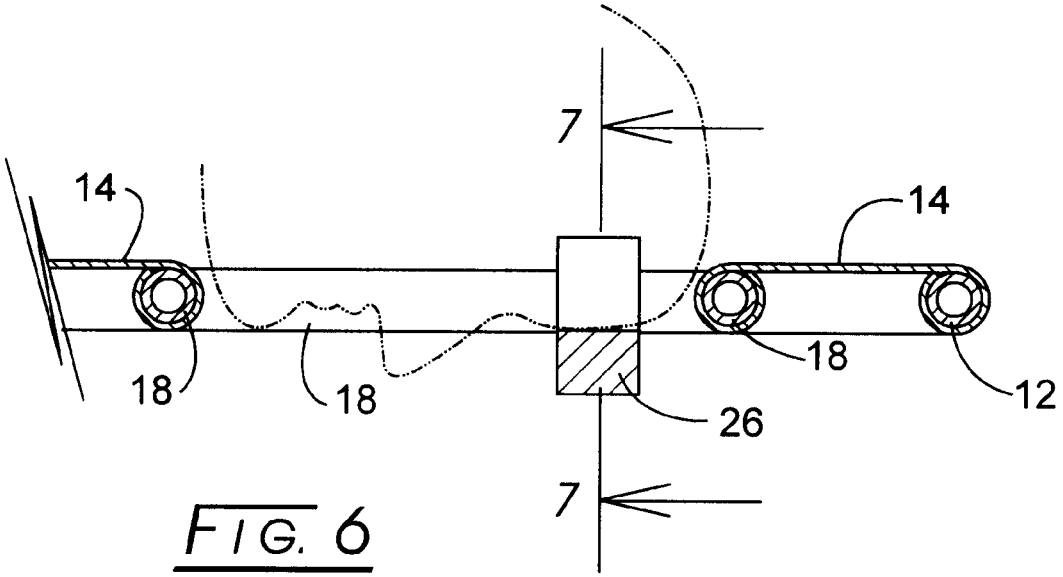
FIG. 6 is a section view taken at line 6—6 of FIG. 5.
Figure 7:
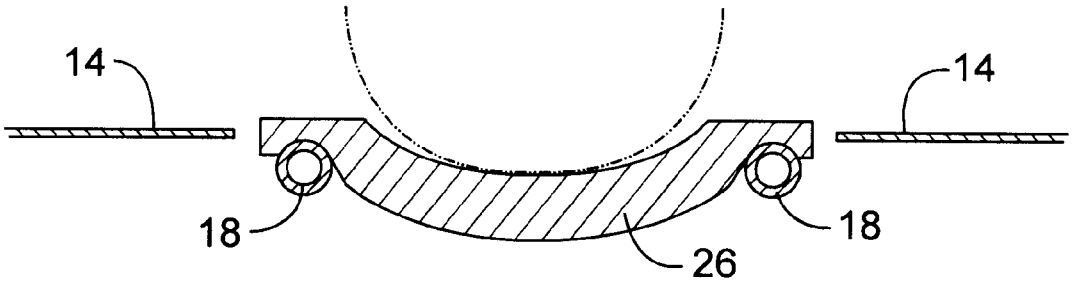
FIG. 7 is a section view taken at line 7—7 of FIG. 6.

I provide human-body support surface 14 with a face-opening 16 positioned centrally of the width of cot 10 and near or adjacent one end of the cot. Opening 16 is preferably defined by an essentially rigid or non-yieldable opening frame 18 that is either adhesively bonded to support surface 14 (FIGS. 1 through 4) or sewn in position in the fabric (FIGS. 5 through 7). Opening frame 18 and the opening which it defines are preferably elliptical in planform with a major axis length of approximately 10 inches and a minor axis length of approximately 6 inches so as to readily receive or accommodate the face of the cot user when the user is in a face-down supine position on the cot.

In the FIGS. 1 through 4 embodiment of the invention cot construction 10 includes a head-support element 20 that is removably or adjustably secured to the material of body-support surface 14 by co-operating conventional hook and loop fastener (Velcro) straps 22, 24. One of such hook and loop straps is adhesively bonded or sewn to surface element 14, and the other is adhesively bonded to head-support element 20.

In the FIGS. 5 through 7 embodiment of the invention cot construction 10 includes a head-support element 26 that slidably rests upon opening frame element 18, such not being secured in position by fasteners. In each embodiment of the invention the adjustably positioned head-support element 20 or 26 is preferably molded of a relatively rigid non-metallic material such as a blow-molded polyethylene resin, and may optionally covered with a resilient padding material.

Figure 3:
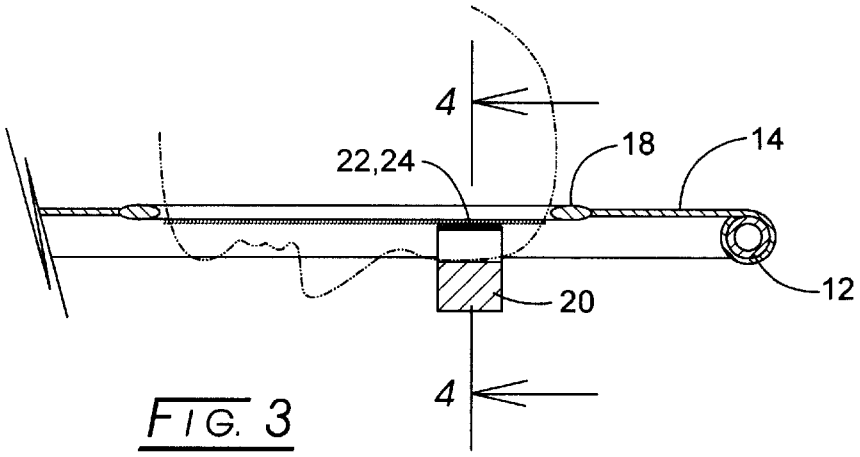
FIG. 3 is a section view taken at line 3—3 of FIG. 1.
Figure 4:
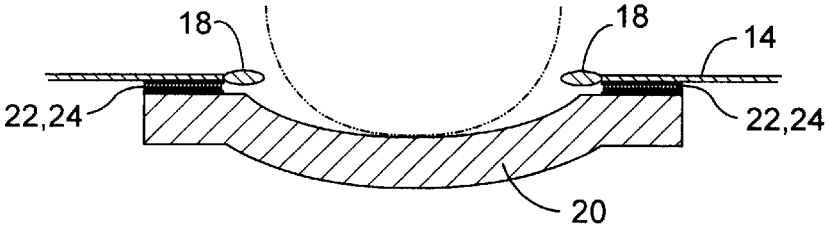
FIG. 4 is a section view taken at line 4—4 of FIG. 3.

When cot construction 10 is utilized for its intended purpose, the human using the unit assumes a face-down, supine position on body-support surface 14 with his face positioned within face-opening 16. Head-support element 20 (or 26) may then be readily adjusted so that its position will correspond to the position of the user's forehead as shown in FIG. 3 (or FIG. 6).

Various changes may be made to the shapes, sizes, and materials of construction utilized in the tanning cot invention without departing from the scope or intent of the claims which follow.

I claim, as my invention:

1. A tanning cot assembly comprising:

a portable and foldable rigid support frame element (12);

a yieldable human-body support surface element (14) carried by said support frame element (12);

an opening frame element (18) positioned within said support surface element (14) and defining an interior face opening (16); and a positionally-adjustable head-support element (20,26) supported by said yieldable human-body support surface element (14) and spanning said opening frame element (18) interior face opening (16).

2. The tanning cot assembly invention defined by claim 1 wherein said head-support element (20) is secured to said yieldable human-body support surface element (14) by co-operating loop strap (22) and hook strap (24) fastener elements.

3. The tanning cot assembly invention defined by claim 1 wherein said head-support element (26) is positioned upon and slidably supported by said opening frame element (18).

* * * * *